US006547168B2

(12) United States Patent
Suzuki

(10) Patent No.: US 6,547,168 B2
(45) Date of Patent: Apr. 15, 2003

(54) COATING HEAD

(75) Inventor: Tsuneaki Suzuki, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 3 days.

(21) Appl. No.: 09/788,767

(22) Filed: Feb. 20, 2001

(65) Prior Publication Data

US 2001/0025893 A1 Oct. 4, 2001

(30) Foreign Application Priority Data

Feb. 22, 2000 (JP) ..... 2000-044320

(51) Int. Cl.[7] ..... B05B 1/00

(52) U.S. Cl. ..... 239/597; 239/590.5; 239/593; 239/568

(58) Field of Search ..... 239/597, 500, 239/502, 553, 553.2, 590, 590.5, 592, 593, 568

(56) References Cited

U.S. PATENT DOCUMENTS 2,684,690 A * 7/1954 Lee ..... 239/597
3,672,666 A * 6/1972 Shibata et al. ..... 239/590.5
4,347,805 A * 9/1982 Ernest ..... 118/63
4,813,611 A * 3/1989 Fontana ..... 239/590.5
6,170,094 B1 * 1/2001 Weise et al. ..... 239/590.5

FOREIGN PATENT DOCUMENTS

| | | |
|---|---|---|
| JP | 9276769 | 10/1997 |
| JP | 9289161 | 11/1997 |
| JP | 11000601 | 1/1999 |

* cited by examiner

*Primary Examiner*—Henry C. Yuen
*Assistant Examiner*—Dinh Q. Nguyen
(74) *Attorney, Agent, or Firm*—Ladas & Parry

(57) ABSTRACT

The present invention is to improve the coating quality by restraining non-uniformity and fluctuation of the ejection amount. A coating head comprises a liquid pool part formed in a bottom part of the coating head, a liquid ejecting slit communicating with the liquid pool part, opened to the atmosphere, and a liquid supply path formed parallel with the liquid ejecting slit with an interval, with one end communicating with the liquid supply opening and the other end communicating with the liquid pool part, wherein the liquid supply path comprises a first chamber communicating with the liquid supply opening, tilted toward the longitudinal direction end part, a second chamber communicating with the first chamber, narrower than the first chamber, and a slit with one end communicating with the second chamber and the other end communicating with the liquid pool part, further narrower than the second chamber.

4 Claims, 4 Drawing Sheets

COATING HEAD

BACKGROUND OF THE INVENTION

The present invention relates to a coating head for coating various kinds of materials such as a resist, and a coloring sensitive material on a substrate in a production process of a semiconductor, a liquid crystal display device, a color filter, or the like.

Conventional coating heads have adopted a coating method by extruding a pressured liquid from a certain liquid ejecting slit as found in a dye coat head, a curtain coat head, or the like. FIG. 4(A) is an entire perspective view of conventional coating head and substrate, FIG. 4(B) is a cross-sectional view of the central part in the longitudinal direction of the coating head of FIG. 4(A) taken on the plane parallel with the paper surface, FIG. 4(C) is a cross-sectional view taken along the line C—C of FIG. 4(B), and FIG. 4(D) is a diagram for explaining the coating state.

In FIG. 4(A), a coating head 2 is provided on the lower surface of a substrate 1 such that the substrate 1 and the coating head 2 are moved relatively in the arrow P direction in the figure. A coating liquid supply tube 3 is mounted on the coating head 2.

As shown in FIGS. 4(B) and 4(C), the coating head 2 comprises a liquid supply opening 5 formed in the lower center part, a first chamber 6 communicating with the liquid supply opening 5, a second chamber 7 communicating with the first chamber 6, narrower than the first chamber 6, and a liquid ejecting slit 8 communicating with the second chamber 7, further narrower than the second chamber 7. Furthermore, the lower surface and the upper surface of the first chamber 6 are provided as parallel inclined surfaces 6*a* and 6*b* tilted from the liquid supply opening 5 upward to right and left sides, and the upper surface of the second chamber 7 is provided as a horizontal surface 7*a*.

In the coating head 2 with the above-mentioned configuration, a coating liquid from the liquid supply opening 5 is extruded from the liquid ejecting slit 8 via the first chamber 6 and the second chamber 7. At the time, the lower surface and the upper surface of the first chamber 6 are provided as the inclined surfaces 6*a* and 6*b*, the upper surface of the second chamber 7 is provided as the horizontal surface 7*a*, and the first chamber 6, the second chamber 7, and the liquid ejecting slit 8 are formed so as to be narrower successively. Therefore, the pressure loss of the coating liquid can be homogeneous from the liquid supply opening 5 to the right and left entire surface of the liquid ejecting slit 8, and thus the coating liquid can be extruded homogeneously from the entire surface of the liquid ejecting slit 8 as shown by the arrows in FIG. 4(B).

According to the above-mentioned conventional coating head, the first and second chambers 6 and 7 are designed and produced so as to have the optimum shape in view of the coating liquid viscosity, the rheology characteristic, the supply rate (flow amount), or the like in order to extrude the coating liquid homogeneously from the entire surface of the liquid ejecting slit 8.

However, a highly sophisticated process of the inclined surfaces 6*a* and 6*b* of the first chamber 6, the horizontal surface 7*a* of the second chamber 7 and the liquid ejecting slit 8 inside the coating head 2 is limited. Moreover, a problem is involved in that common use of the coating head for different coating liquids is difficult. Furthermore, a problem is involved in that use with the optimum internal shape cannot always be realized due to fluctuation of the ejection amount, the rate, and the pressure in a process so that ejection amount non-uniformity is generated.

Moreover, in the case intermittent coating (method of coating only by a one way process at one time) using this coating head is executed, coating non-uniformity M is generated from midway to the end of coating as shown in FIG. 4(D), particularly in the case of a highly viscous material. This is because the flow is changed drastically to right and left from the supply opening Q in the central part in the case of the highly viscous material so that the flow amount in the center part is reduced.

SUMMARY OF THE INVENTION

In order to solve the above-mentioned conventional problems, an object of the present invention is to provide a coating head, capable of restraining non-uniformity and fluctuation of the ejection amount so as to improve the coating quality.

In order to achieve the object, a first aspect of the present invention is a coating head comprising a liquid supply opening formed in a bottom part of the coating head, a first chamber communicating with the liquid supply opening, tilted toward the longitudinal direction end part, a second chamber communicating with the first chamber, narrower than the first chamber, a liquid ejecting slit communicating with the second chamber, further narrower than the second chamber, and a third chamber formed halfway in the liquid ejecting slit, elongating in the horizontal direction.

Moreover, a second aspect of the present invention is a coating head comprising a liquid pool part formed in a bottom part of the coating head, a liquid ejecting slit communicating with the liquid pool part, opened to the atmosphere, and a liquid supply path formed parallel with the liquid ejecting slit with an interval, with one end communicating with the liquid supply opening and the other end communicating with the liquid pool part, wherein the liquid supply path comprises a first chamber communicating with the liquid supply opening, tilted toward the longitudinal direction end part, a second chamber communicating with the first chamber, narrower than the first chamber, and a slit with one end communicating with the second chamber and the other end communicating with the liquid pool part, further narrower than the second chamber.

According to the present invention, since a chamber is provided halfway in a liquid ejecting slit, or a liquid pool part is formed on a bottom part of a coating head, the coating amount can be ensured sufficiently as well as the pressure fluctuation can be absorbed, and thus the coating quality can be improved by restraining non-uniformity and fluctuation of the ejection amount. Moreover, according to the second aspect of the present invention, since the coating liquid paths face with each other with respect to a liquid pool part, the length of the liquid ejecting slit can be ensured sufficiently so that ejection can be enabled by extruding with little influence by the flow, and thus the coating quality can be improved by making the ejection accuracy better.

BRIEF DESCRIPTION OF THE DRAWINGS

FIG. 1(A) is an entire perspective view of a coating head and a substrate; FIG. 1(B) is a cross-sectional view of the central part of the coating head of FIG. 1(A) taken on the plane perpendicular to the paper surface, and FIG. 1(C) is a cross-sectional view taken along the line C—C of FIG. 1(B).

FIG. 2(A) is across-sectional view similar to FIG. 1(C), and FIG. 2(B) is a cross-sectional view taken along the line B—B of FIG. 2(A).

FIG. 3(A) is an entire perspective view of a coating head and a substrate; FIG. 3(B) is a cross-sectional view of the central part of the coating head of FIG. 3(A) taken on the plane perpendicular to the paper surface, and FIG. 3(C) is a cross-sectional view taken along the line C—C of FIG. 3(B).

DESCRIPTION OF THE PREFERRED EMBODIMENTS

Figure 1A:
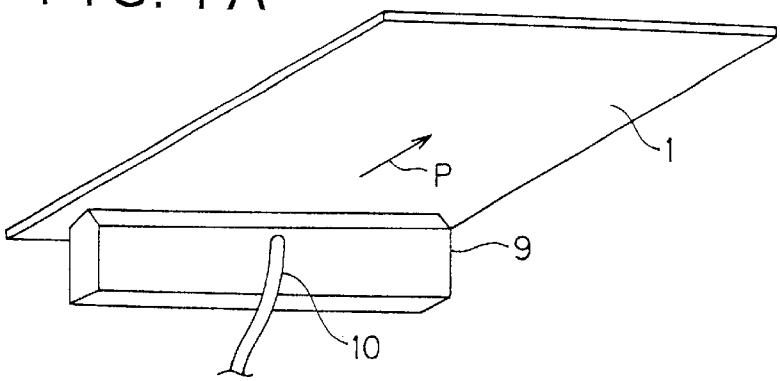
FIGS. 1(A) to 1(C) show an embodiment of a coating head according to the present invention.
Figure 1B:
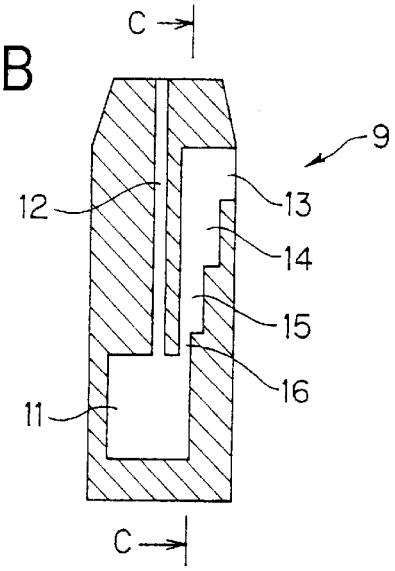
Figure 1C:
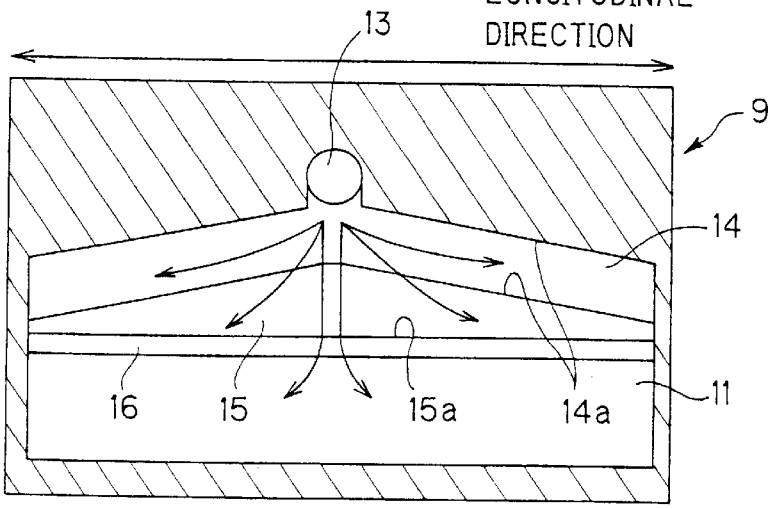

Hereinafter, embodiments of the present invention will be explained with reference to the accompanied drawings. FIGS. 1(A) to 1(C) show an embodiment of a coating head according to the present invention; FIG. 1(A) is an entire perspective view of a coating head and a substrate; FIG. 1(B) is across-sectional view of the central part of the coating head of FIG. 1(A) taken on the plane perpendicular to the paper surface, and FIG. 1(C) is a cross-sectional view taken along the line C—C of FIG. 1(B).

In FIG. 1(A), a coating head 9 is provided on the lower surface of a substrate 1 such that the substrate 1 and the coating head 9 are moved relatively in the arrow P direction in the figure. A coating liquid supply tube 10 is mounted on the side surface upper part of the coating head 9.

As shown in FIGS. 1(B) and 1(C), a liquid pool part 11 formed in a bottom part of the coating head 9, is provided with a liquid ejecting slit 12 opened to the atmosphere, formed communicating with the liquid pool part 11 as well as liquid supply paths 14, 15 and 16 formed communicating therewith with an interval with the liquid ejecting slit 12. A liquid supply opening 13 for the liquid ejecting slit 12 is formed on the center side surface upper part of the coating head 9. A first chamber 14 communicating with the liquid supply opening 13, is formed tilted toward the longitudinal direction end part so as to be away from the liquid supply opening 13. A second chamber 15 communicating with the first chamber 14, is formed narrower than the first chamber 14. A slit 16 connected with the second chamber 15 and the liquid pool part 11, is formed further narrower than the second chamber 15. Furthermore, the lower surface and the upper surface of the first chamber 14 are provided as parallel inclined surfaces 14*a* tilted from the liquid supply opening 13 to the slit 16, and the slit 16 side surface of the second chamber 15 is provided as a horizontal surface 15*a*. Here, the thickness and the height of the liquid supply paths 14, 15 and 16 are determined such that the pressure loss can be homogeneous in view of the coating liquid viscosity, the rheology characteristic, or the like, however the total height of the liquid supply paths is preferably 50 to 60 mm at the center part, and 20 to 30 mm at the end part.

In the coating head 9 with the above-mentioned configuration, a coating liquid extruded from the liquid supply opening 13 is extruded from the liquid ejecting slit 12 via the first chamber 14, the second chamber 15, the slit 16 and the liquid pool part 11. At the time, since the lower surface and the upper surface of the first chamber 14 are provided as the inclined surfaces 14*a*, the liquid ejecting slit 16 side surface of the second chamber 15 is provided as the horizontal surface 15*a*, and the first chamber 14, the second chamber 15, and the liquid ejecting slit 16 are formed to be narrower successively in this order, the pressure loss of the coating liquid can be homogeneous from the liquid supply opening 13 to the right and left side end parts at the outlet of the liquid ejecting slit 16, and thus the coating liquid supplied to the liquid pool part 11, with the pressure fluctuation absorbed in the liquid pool part, can be extruded homogeneously from the entire surface of the liquid ejecting slit 12.

Figure 2A:
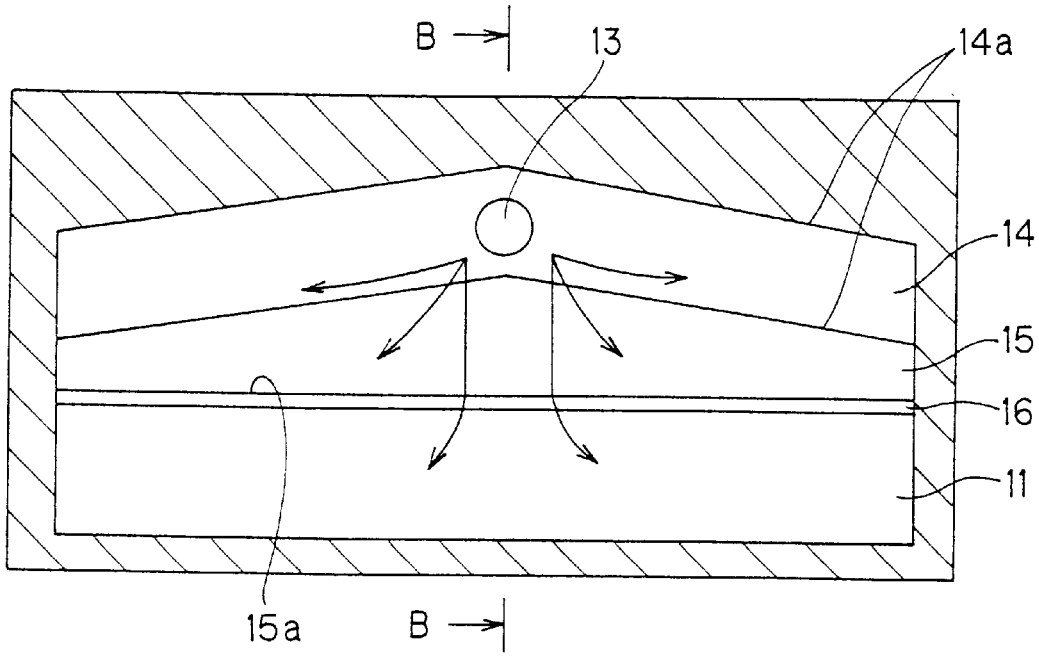
FIGS. 2(A) and 2(B) show a modified embodiment of the embodiment of FIGS. 1(A) to 1(C)
Figure 2B:
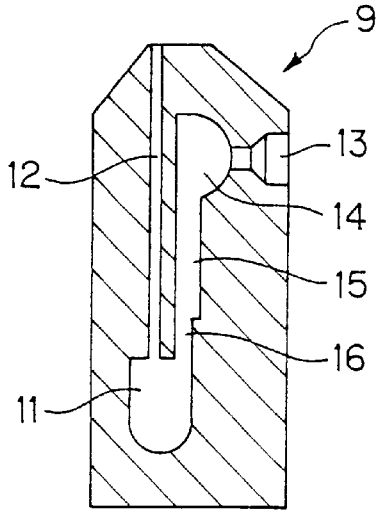

FIGS. 2(A) and 2(B) show a modified embodiment of the above-mentioned embodiment; FIG. 2(A) is across-sectional view similar to FIG. 1(C), and FIG. 2(B) is a cross-sectional view taken along the line B—B of FIG. 2(A). In the explanation provided below, the same configuration as that of the embodiment of FIGS. 1(A) to 1(C) is applied with the same numeral and further description is not given. This modified embodiment differs from the embodiment of FIGS. 1(A) to 1(C), wherein the liquid pool part 11 and the first chamber 14 have a rectangular cross-section, in that the liquid pool part 11 and the first chamber 14 have a substantially semicircular cross-section.

Figure 3A:
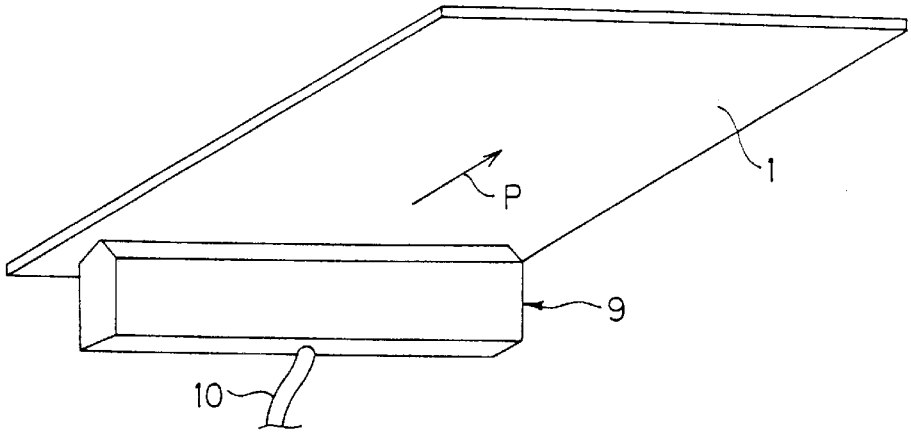
FIGS. 3(A) to 3(C) show another embodiment of a coating head according to the present invention.
Figure 3B:
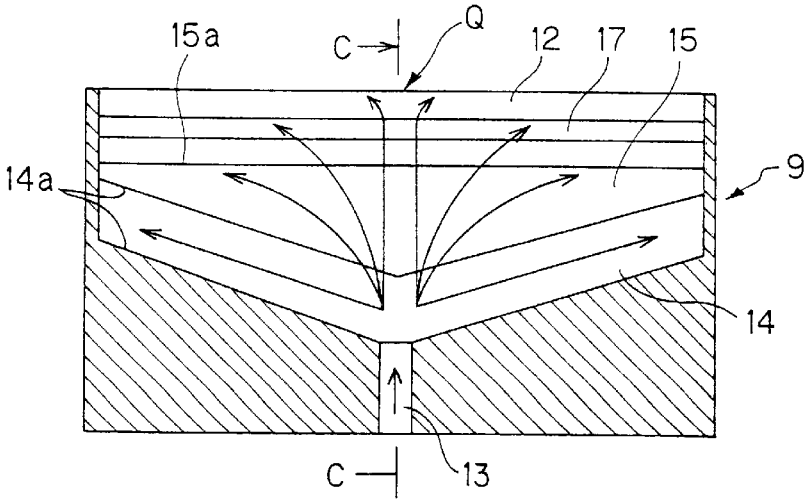
Figure 3C:
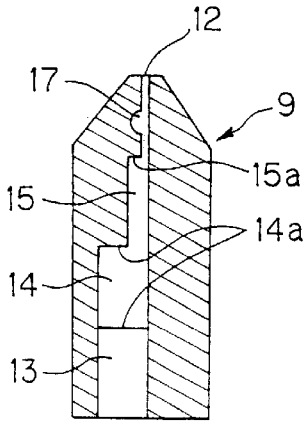
Figure 4A:
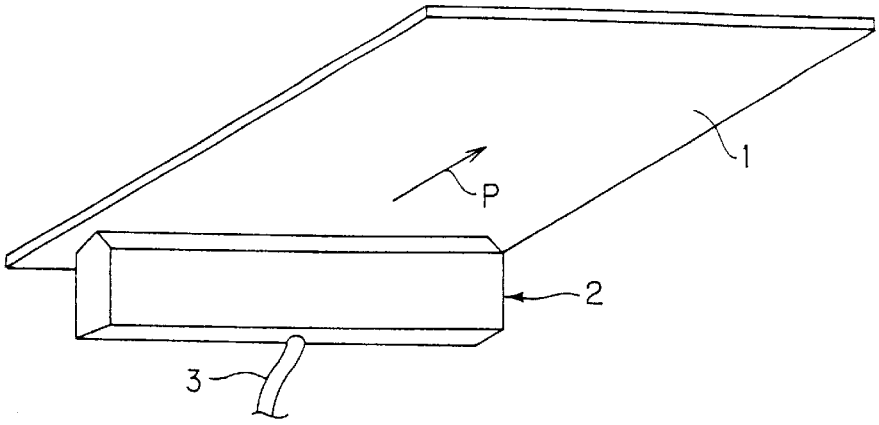
FIG. 4(A) is an entire perspective view of conventional coating head and substrate.
Figure 4B:
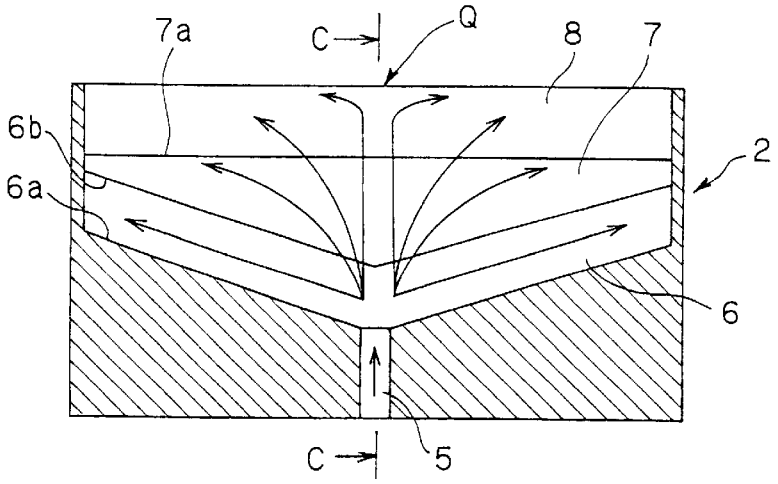
FIG. 4(B) is a cross-sectional view of the central part in the longitudinal direction of the coating head of FIG. 4(A) taken on the plane parallel with the paper surface.
Figure 4C:
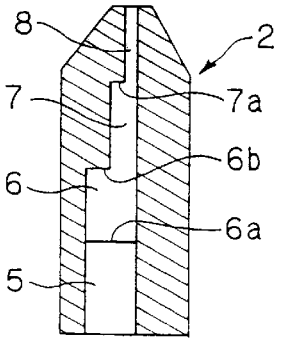
FIG. 4(C) is a cross-sectional view taken along the line C—C of FIG. 4(B)
Figure 4D:
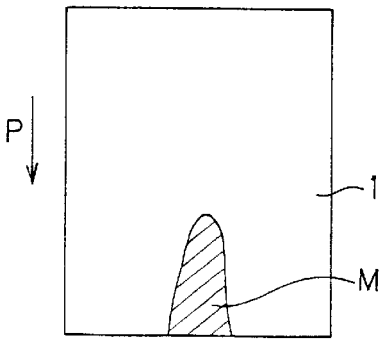
FIG. 4(D) is a diagram for explaining the coating state.

FIGS. 3(A) to 3(C) show another embodiment of a coating head according to the present invention; FIG. 3(A) is an entire perspective view of a coating head and a substrate; FIG. 3(B) is a cross-sectional view of the central part of the coating head of FIG. 3(A) taken on the plane perpendicular to the paper surface, and FIG. 3(C) is a cross-sectional view taken along the line C—C of FIG. 3(B).

The coating head 9 comprises a liquid supply opening 13 formed in a lower central part, a first chamber 14 communicating with the liquid supply opening 13, a second chamber 15 communicating with the first chamber 14, narrower than the first chamber 14, a liquid ejecting slit 12 communicating with the second chamber 15, further narrower than the second chamber 15, and a third chamber 17 formed halfway in the liquid ejecting slit 12, elongating in the horizontal direction. Furthermore, the lower surface and the upper surface of the first chamber 14 are provided as parallel inclined surfaces 14*a* tilted from the liquid supply opening 13 upward to right and left, and the upper surface of the second chamber 15 is provided as a horizontal surface 15*a*. In this embodiment, the entire amount needed for coating at one time can be provided from the coating liquid in the third chamber 17.

In the coating head 9 with the above-mentioned configuration, a coating liquid from the liquid supply opening 13 is extruded from the liquid ejecting slit 12 via the first chamber 14, the second chamber 15, and the third chamber 17. At the time, since the lower surface and the upper surface of the first chamber 14 are provided as the inclined surfaces 14*a*, the liquid ejecting slit 16 side surface of the second chamber 15 is provided as the horizontal surface 15*a*, and the first chamber 14, the second chamber 15, and the liquid ejecting slit 12 are formed so as to be narrower successively in this order, the pressure loss of the coating liquid can be homogeneous from the liquid supply opening 13 to the right and left side end parts at the outlet Q of the liquid ejecting slit 12, and thus the coating liquid supplied to the third chamber 17, with the pressure fluctuation absorbed in the third chamber 17, can be extruded homogeneously out of the entire surface of the liquid ejecting slit 12.

The present invention is not limited to the above-mentioned embodiments, however various modifications can be adopted as well. For example, although the coating head is provided on the lower surface of the substrate so as to coat the lower surface of the substrate in the above-mentioned embodiments, the coating head can be provided on the upper surface of the substrate so as to coat the upper surface of the substrate.

What is claimed is:

1. A coating head comprising, a bottom part in which a liquid supply opening is formed, a first chamber communicating with the liquid supply opening, formed so as to be tilted toward the longitudinal direction end part, a second chamber communicating with the first chamber, formed so as to be narrower than the first chamber, a liquid ejecting slit communicating with the second chamber, formed so as to be further narrower than the second chamber, and a third chamber elongating in the horizontal direction, formed halfway in the liquid ejecting slit.

2. A coating device comprising a coating head according to claim 1.

3. A coating head comprising a liquid pool part formed in a bottom part of the coating head, a liquid ejecting slit communicating with the liquid pool part, formed so as to be opened to the atmosphere, and a liquid supply path formed parallel with the liquid ejecting slit with an interval, with one end communicating with the liquid supply opening and the other end communicating with the liquid pool part, wherein the liquid supply path comprises a first chamber communicating with the liquid supply opening, formed so as to be tilted toward the longitudinal direction end part, a second chamber communicating with the first chamber, formed so as to be narrower than the first chamber, and a slit with one end communicating with the second chamber and the other end communicating with the liquid pool part, formed so as to be further narrower than the second chamber.

4. A coating device comprising a coating head according to claim 3.

* * * * *